US006971902B2

(12) United States Patent
Taylor et al.

(10) Patent No.: US 6,971,902 B2
(45) Date of Patent: Dec. 6, 2005

(54) SELF LOADING LGA SOCKET CONNECTOR

(75) Inventors: Attalee S. Taylor, Palmyra, PA (US); Lynn Robert Sipe, Mifflintown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/790,515

(22) Filed: Mar. 1, 2004

(65) Prior Publication Data

US 2005/0191890 A1 Sep. 1, 2005

(51) Int. Cl.[7] ..... H01R 4/50; H01R 13/625; H01R 13/627

(52) U.S. Cl. ..... 439/342; 439/331; 439/940

(58) Field of Search ..... 439/342, 341, 439/70, 526, 527, 353, 345, 331, 330, 940, 439/71, 73

(56) References Cited

U.S. PATENT DOCUMENTS 4,456,318 A * 6/1984 Shibata et al. ..... 439/68
4,502,747 A 3/1985 Bright et al. ..... 339/75 M
4,826,440 A * 5/1989 Plocek et al. ..... 439/70
5,344,334 A 9/1994 Laub et al. ..... 439/331
6,142,809 A * 11/2000 Fukunaga ..... 439/331
6,155,859 A * 12/2000 Choy ..... 439/331
6,371,786 B1 * 4/2002 Howell et al. ..... 439/342
6,485,320 B1 11/2002 Ma ..... 439/342
6,485,321 B1 * 11/2002 Trout et al. ..... 439/342
6,758,691 B1 * 7/2004 McHugh et al. ..... 439/331
6,877,990 B2 * 4/2005 Liao et al. ..... 439/41
2004/0224548 A1 * 11/2004 Yu ..... 439/342

* cited by examiner

*Primary Examiner*—Chandrika Prasad

(57) ABSTRACT

An electrical connector is provided that includes a socket housing holding an array of electrical contacts and a load plate rotatably coupled to the housing and rotatable between an open position and a closed position. The load plate includes a channel that is configured to receive an electronic package when the load plate is in the open position. The load plate loads the package into the housing as the load plate is rotated to the closed position.

23 Claims, 5 Drawing Sheets

SELF LOADING LGA SOCKET CONNECTOR

BACKGROUND OF THE INVENTION

The invention relates generally to area array socket connectors and particularly to a land grid array (LGA) socket connector.

Competition and market demands have continued the trends toward faster, higher performance electrical systems, particularly with regard to computer systems. Along with the development of surface mount technology in the design of printed circuit boards, higher density electrical circuits, including higher density interconnect components have been developed to meet the increasing demand for higher performance electrical systems.

As is well understood in the art, surface mountable packaging allows for the connection of the package to pads on the surface of the circuit board rather than by contacts or pins soldered in plated holes going through the circuit board. As used herein, the term "package" shall refer to a chip carrying module that is to be mounted to a circuit board. Surface mount technology allows for an increased component density on a circuit board, thereby saving space on the circuit board.

Area array socket connectors have evolved, along with surface mount technology, as one high density interconnect methodology. One significant application of this technology, for example, is the land grid array (LGA) socket connector that is used with an LGA package. One major advantage of the LGA package lies in its durability. The LGA package is not easily damaged during the installation or removal process or by handling generally. At least some of the other IC packages, such as a pin grid array (PGA) package, have a standardized layout, or form factor, for contact leads or pins on the package. These contact leads are somewhat fragile and can be damaged if not handled properly. By contrast, with an LGA package, there is nothing protruding from the package that can get bent or otherwise damaged during normal handling. The LGA typically could only have some foreign material come in contact with the land or contact area. The land, however, could be scratched if the package was subjected to abuse.

While the LGA package is quite durable, the LGA socket is somewhat less so. In at least some LGA sockets, when the socket is opened, the electrical contacts, referred to as contact beams, are exposed and the LGA package is loaded directly on top of the contact beams. The LGA socket is designed for loading and unloading of the package in a vertical direction, e.g. normal to the circuit board, which requires that a socket cover or load plate and any other actuation components have at least a ninety degree range of movement so that they can be clear of a load path for the package. This exposes the flexible surface mount contact beams, rendering the beams susceptible to damage during loading and unloading of the package. The beams may be broken, bent, or otherwise deformed which results in misalignment of the beams with respect to the package.

Thus, a need exists for an LGA socket that reduces the susceptibility of the LGA surface mount contacts to damage.

BRIEF DESCRIPTION OF THE INVENTION

In one aspect, an electrical connector is provided that includes a socket housing holding an array of electrical contacts and a load plate rotatably coupled to the housing and rotatable between an open position and a closed position. The load plate includes a channel that is configured to receive an electronic package when the load plate is in the open position. The load plate loads the package into the housing as the load plate is rotated to the closed position.

Optionally, the connector includes a handle rotatably coupled to the housing to lock the load plate in the closed position. A biasing member is coupled between the load plate and the housing to bias the load plate in the open position. The load plate includes first and second opposed sides, each of which extends from a forward load plate latching end to a rearward load plate pivoting end. Each side includes a downwardly curved portion that applies a downward load to the package when the load plate is in the closed position. The load plate includes a load plate stop tab extending therefrom that engages the housing to limit an opening of the load plate to restrict access to the contact array when the load plate is rotated to the open position.

In another aspect, an electrical connector is provided. The connector includes a socket housing holding an array of electrical contacts. The housing includes a guide member to guide an electronic package onto the contact array as the package is loaded into the housing. A load plate is rotatably coupled to the housing and is rotatable between an open position and a closed position. The load plate includes a channel that is configured to receive the package when the load plate is in the open position. The load plate loads the package into the housing as the load plate is rotated to the closed position.

In another aspect, an electrical connector is provided that includes a socket housing holding an array of electrical contacts. The housing includes a guide member to guide an electronic package onto the contact array as the package is loaded into the housing. A load plate is rotatably coupled to the housing and is rotatable between an open position and a closed position. The load plate includes a channel that is configured to receive the package when the load plate is in the open position, and a lip that orients the package with respect to the housing. The load plate loads the package into the housing as the load plate is rotated to the closed position.

DETAILED DESCRIPTION OF THE INVENTION

Figure 1:
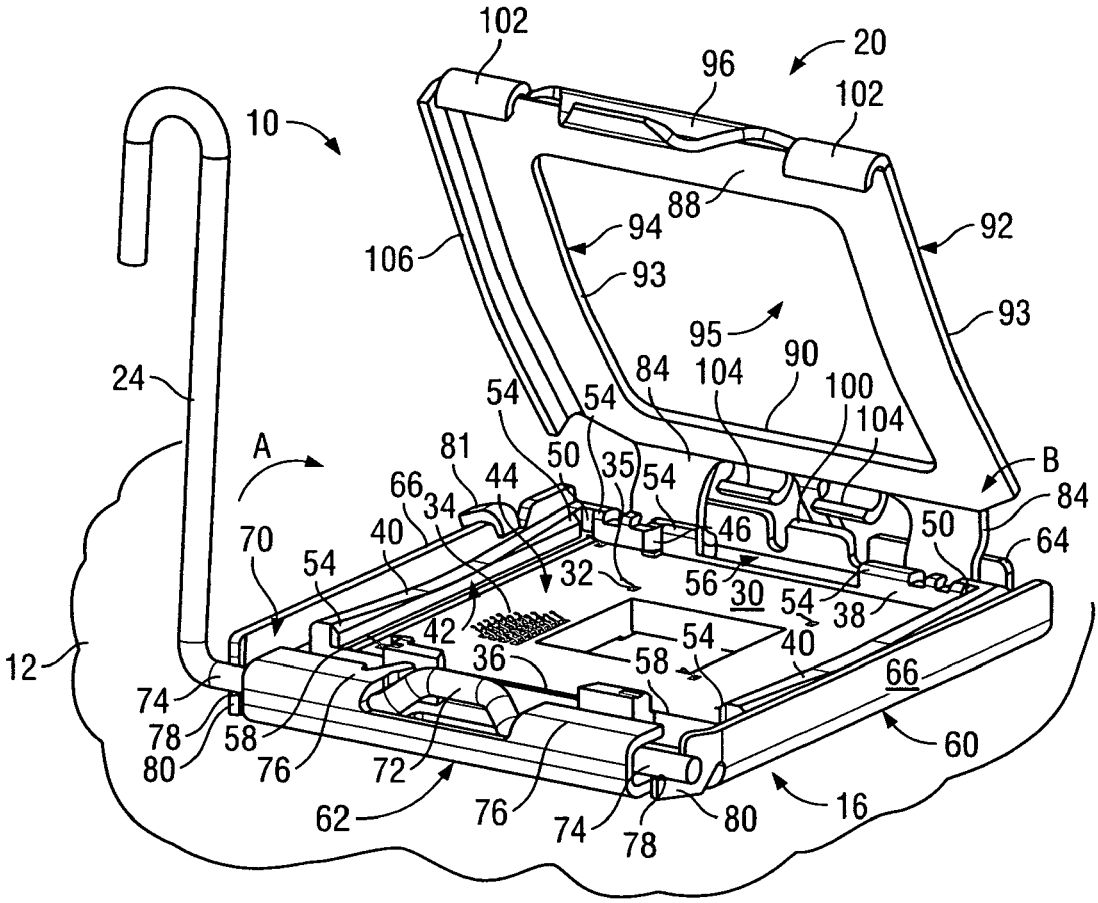
FIG. 1 is a perspective front view of a socket connector formed in accordance with an exemplary embodiment of the present invention.
Figure 2:
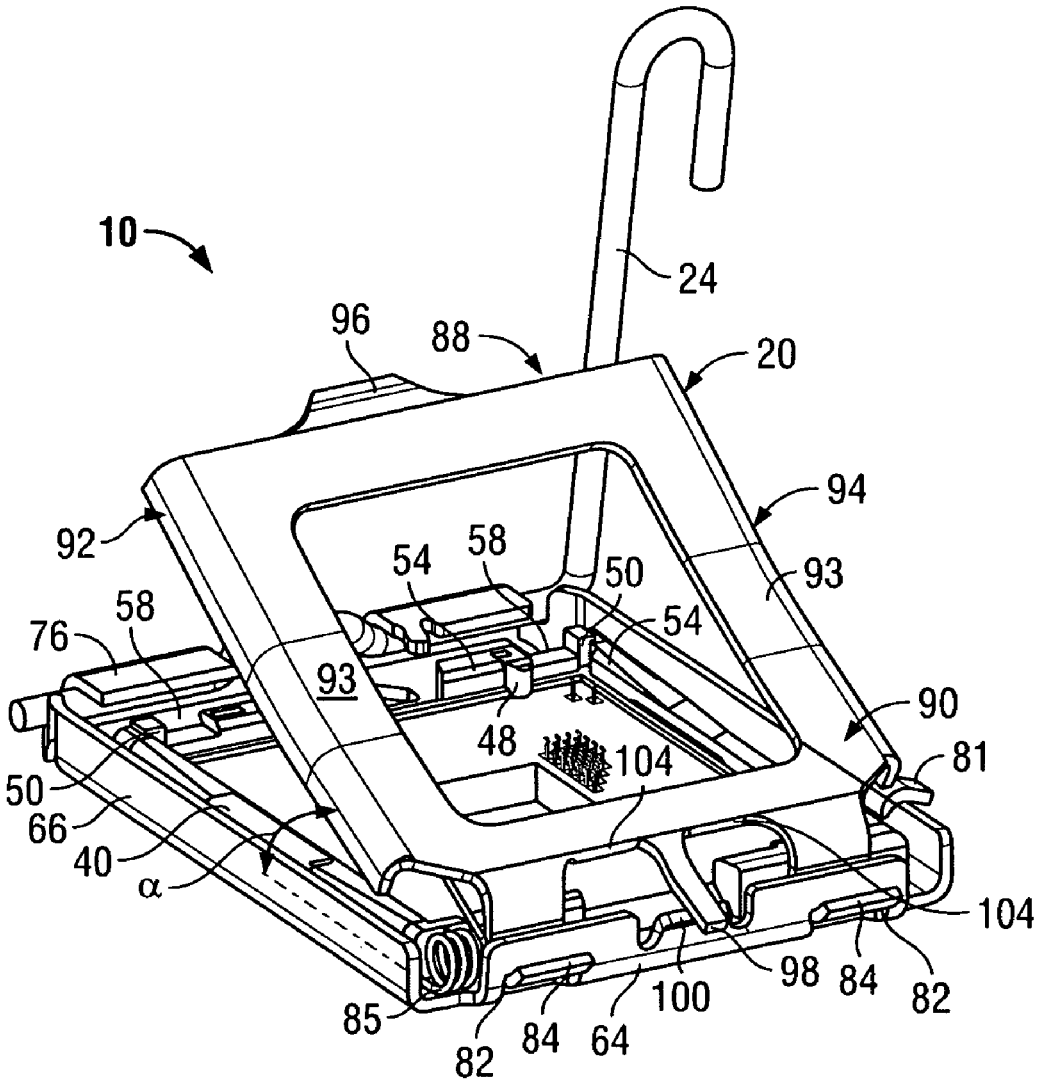
FIG. 2 is a rear perspective view of the connector shown in FIG. 1.

FIG. 1 is a front perspective view of an exemplary socket connector 10 formed in accordance with an exemplary embodiment of the present invention. FIG. 2 is a rear perspective view of the socket connect 10 shown in FIG. 1. While the connector 10 will be described with particular reference to a land grid array (LGA) module or package, it is to be understood that other electronic module types are not intended to be excluded.

The connector 10 is surface mounted to a circuit board 12 that may be used, among other applications, in a personal computer or in a server application. The connector 10 can be used to mount a central processing unit (CPU) or other chip carrying module to the circuit board 12. The connector 10 includes a socket housing 16 with a stiffener plate 60, a load plate 20, and a latch handle 24.

The housing 16 includes a base 30 which is fabricated from a dielectric material and includes an array of contact cavities 32 that hold an array 34 of individual electrical contacts 35. The housing 16 is substantially rectangular in shape, although other geometric forms and shapes may be employed in alternative embodiments. The housing 16 includes front and back interior walls 36 and 38 respectively, and interior side walls 40. The front and back walls 36 and 38, along with the side walls 40 combine to form a perimeter wall 42 that surrounds the base 30. The front and back walls 36, 38, and side walls 40 extend above the base 30 and thereby define a recess 44 within which the base 30 is located and within which an LGA package (not shown in FIG. 1) is received.

The back wall 38 includes a key 46. The front wall 36 also includes a key 48 (shown in FIG. 2). The keys 46 and 48 are provided to assure that the LGA package (see FIG. 3) is properly oriented with respect to the contact array 34 for placement thereon. A cutout 50 is provided in each corner of the perimeter wall 42 to minimize the possibility of binding in the corners between the package and the perimeter wall 42. Each of the front and back walls 36 and 38 and the side walls 40 forming the perimeter wall 42 are provided with a chamfered or beveled surface generally indicated at 54 along an inner upper surface of each of walls 36, 38, and 40. The beveled surfaces 54 operate as alignment ramps or guide ramps that provide the final alignment of the package and guide the package onto the base 30 and the contact array 34. The back interior wall 38 includes a cutout 56, and the front interior wall 36 has a pair of similar cutouts 58 that will be described in more detail hereinafter.

The housing 16 also includes a stiffener plate 60 that surrounds the perimeter wall 42. The stiffener plate 60 includes a front rail 62, a back rail 64, and opposed side rails 66. Each of the side rails 66 joins the front and back rails 62 and 64 to form a substantially rectangular enclosure 70 wherein the front rail 62 is adjacent the front interior wall 36, the back rail 64 is adjacent the back interior wall 38, and each side rail 66 is adjacent an interior side wall 40.

The handle 24 is rotatably coupled to the stiffener front rail 62. The handle 24 includes a latching section 72 that is positioned between a pair of shaft portions 74. The front rail 62 includes rolled over C-shaped sections 76 that receive shaft portions 74 of the handle 24. Each side rail 66 also includes a bearing surface 78 at a forward end 80 that supports the handle shaft portions 74. One of the side rails 66 also includes a catch 81 that holds the handle 24 when the handle 24 is lowered. As best shown in FIG. 2, back rail 64 includes slots 82 that receive hinge tabs 84 from the load plate 20 that allow rotation of the load plate 20 with respect to the housing 16. A biasing member 85 is provided between the load plate 20 and the stiffening plate 60 that biases the load plate 20 in an open position. In an exemplary embodiment, the biasing member 85 is a coil spring.

Figure 3:
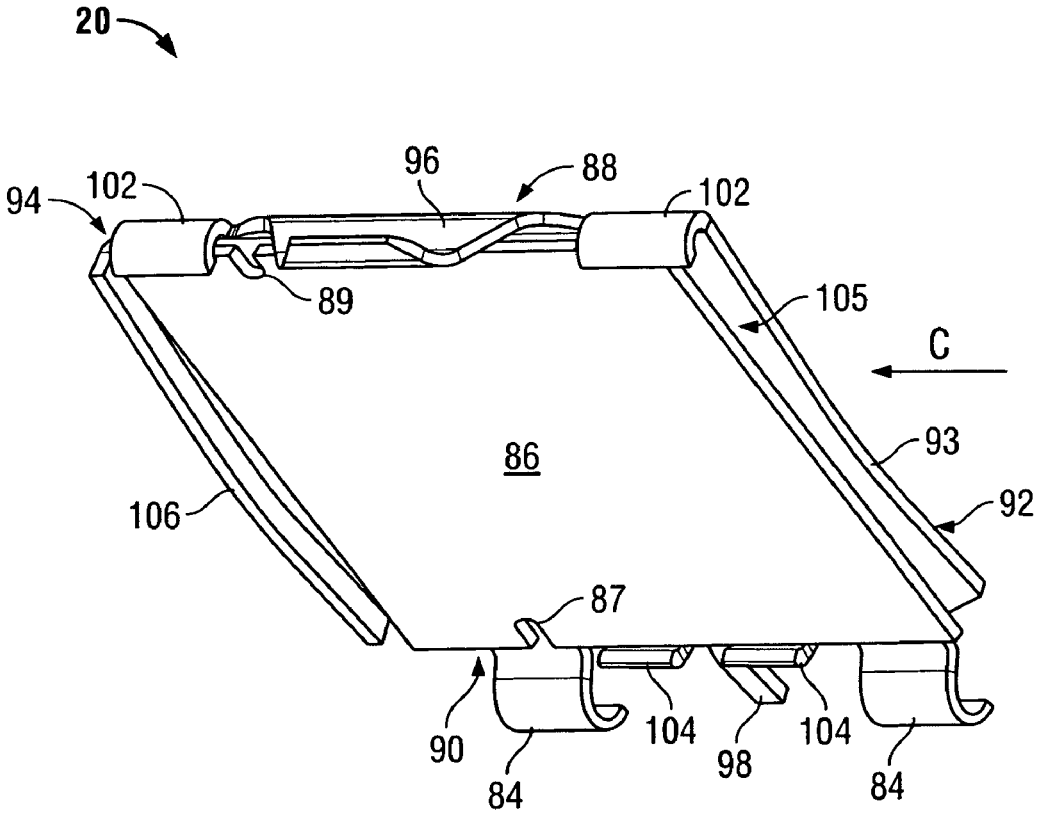
FIG. 3 is a perspective view of the load plate of the connector shown in FIGS. 1 and 2 with an LGA package inserted into the load plate.

The load plate 20 will be described with continued reference to FIGS. 1 and 2, and to FIG. 3 which illustrates the load plate 20 with an LGA package 86 inserted therein. The load plate 20 is generally rectangular in shape, conforming to the shape of the stiffening plate 60. The load plate 20 includes a forward latching end 88, a rearward pivoting end 90, a first side 92 and a second side 94. First and second sides 92 and 94 extend between the forward latching end 88 and the rearward pivoting end 90. The load plate 20 includes a cutout 95 in a central portion thereof.

The forward latching end 88 includes a latch tongue 96 that is engaged by the handle latching section 72 to hold the load plate 20 in a closed position when the load plate 20 is lowered and the latch handle 24 is rotated in the direction of arrow A (see FIG. 1) to a latched position wherein the latch handle 24 is held by the catch 81. The load plate 20 is closed by rotating the load plate in the direction of arrow B (see FIG. 1). The sides 92 and 94 each include a central portion 93 that has a downward curvature such that the load plate 20 applies a downward load to the LGA package 86 to push the package 86 down onto the contact array 34 when the load plate 20 is latched in the closed position.

The load plate 20 includes a stop tab 98 that engages a load plate stop 100 (see FIG. 2) on the back rail 64 that limits the opening of the load plate 20 with respect to the housing 16. In an exemplary embodiment, the opening of the load plate 20, represented by the angle $\alpha$, is limited, for example, to about twenty to about forty degrees. In an LGA connector, such as the connector 10, the contacts 35 of the contact array 34 are exposed, and as such are vulnerable to damage from the imprecise placement and resultant movement of the LGA package 86 across the contact array 34. Damage can also result from fingers or tools, etc. encroaching into the contact array 34. It should be noted that in FIG. 1, the opening of the load plate 20 is exaggerated for convenience in showing the housing 16 detail only.

The load plate 20 is configured to receive the LGA package 86 and load the package 86 into the housing 16 as the load plate 20 is rotated to the closed position. The load plate 20 includes forward retention hooks 102 formed on the forward latching end 88 and rearward retention hooks 104 formed on the rearward pivoting end 90. The retention hooks 102 and 104 cooperate to define a channel 105 (see FIG. 3) that is sized to receive the package 86. The package 86 is received in the load plate 20 by sliding the package 86 between the retention hooks 102 and 104 in the direction of the arrow C (see FIG. 3) such that the package 86 is held by the retention hooks 102 and 104 on the load plate 20. The forward cutouts 58 and the rearward cutout 56 in the housing interior retention walls 36 and 38 respectively, provide clearance for the retention hooks 102 and 104 respectively when the load plate 20 is closed. The package 86 includes key slots 87 and 89 that receive the keys 46 and 48 (see FIGS. 1 and 2) respectively, to assure that the package 86 is properly oriented in the load plate 20 as the load plate 20 is closed. The load plate second side 94 includes a lip 106 formed thereon that acts as a package stop for the package 86. When the package 86 is inserted against the lip, or package stop 106, the package 86 is preliminarily aligned for placement into the housing 16. The first side 92 is unobstructed to receive the package 86.

Figure 4:
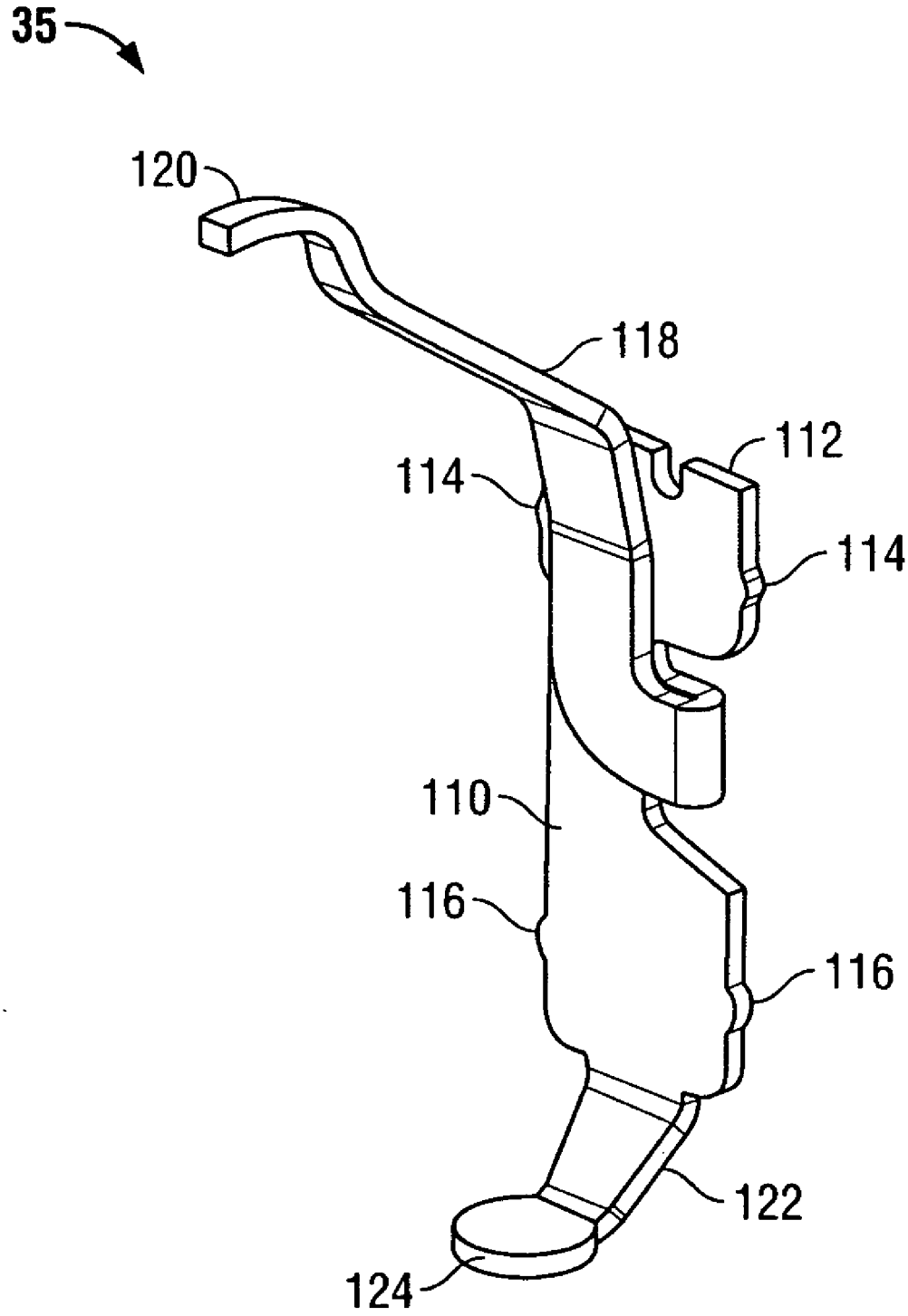
FIG. 4 is a perspective view of an electrical contact for the connector shown in FIG. 1.

FIG. 4 illustrates a perspective view of an exemplary electrical contact 35 for the connector 10. The contact 35 includes a contact body 110 that has an insertion surface 112 and upper and lower retention barbs 114 and 116 respectively. A contact arm 118 extends upwardly from the body 110 and culminates in a contact beam 120 that mates with a pad (not shown) on the LGA package 86 (see FIG. 3). A contact leg 122 extends downwardly from the contact body 110 and culminates in a solder ball paddle 124. A solder ball (not shown) is placed on the underside of the solder ball paddle 124. The contact 35 is electrically and mechanically attached to the circuit board 12 (see FIG. 1) by conventional techniques such as reflow soldering.

In use, the connector 10 reduces the possibility of damage to the contact array 34 during the package loading process. The LGA package 86 (see FIG. 3) is first loaded into the connector load plate 20. The load plate 20 is biased in the open position by the biasing member 85 so that the load plate 20 and the package 86 do not drop onto and potentially damage the contact array 34. In addition, the opening of the load plate 20 is limited by cooperation of the load plate stop tab 98 on the load plate 20 and the load plate stop 100 on the stiffener plate 60 to reduce the possibility of damage to the contact array 34 from foreign objects, tools, or fingers of the user. The package 86 is slid into the load plate 20 in the direction of arrow C from the open side 92 (see FIG. 3) of the load plate 20 and is held by the forward and rearward retention hooks 102 and 104 respectively. The package 86 is slid into the load plate 20 until it is stopped by the package stop, or lip, 106 formed on the second side 94 of the load plate 20. When positioned against the package stop, or lip 106, the package 86 is preliminarily aligned for placement into the housing 16.

The load plate 20 with the package 86 is then rotated downward in the direction of arrow B toward the closed position. When the package 86 reaches the interior perimeter wall 42 in the housing 16, the beveled alignment ramps 54 engage the package 86 and perform a final alignment of the package 86 and position the package 86 for placement on the contact array 34. When the load plate 20 is in the closed position, the handle 24 is rotated in the direction of arrow A so that the latch section 72 engages the latch tongue 96 on the latching end 88 of the load plate 20. The handle 24 is then positioned under the handle catch 81 on the stiffener plate 60 which locks the load plate 20 in the closed position and causes a downward load to be applied to the package 86 from the curvature of the central portions 93 of sides 92 and 94 of the load plate 20. The downward load pushes the package 86 down onto the contact array 34.

Figure 5:
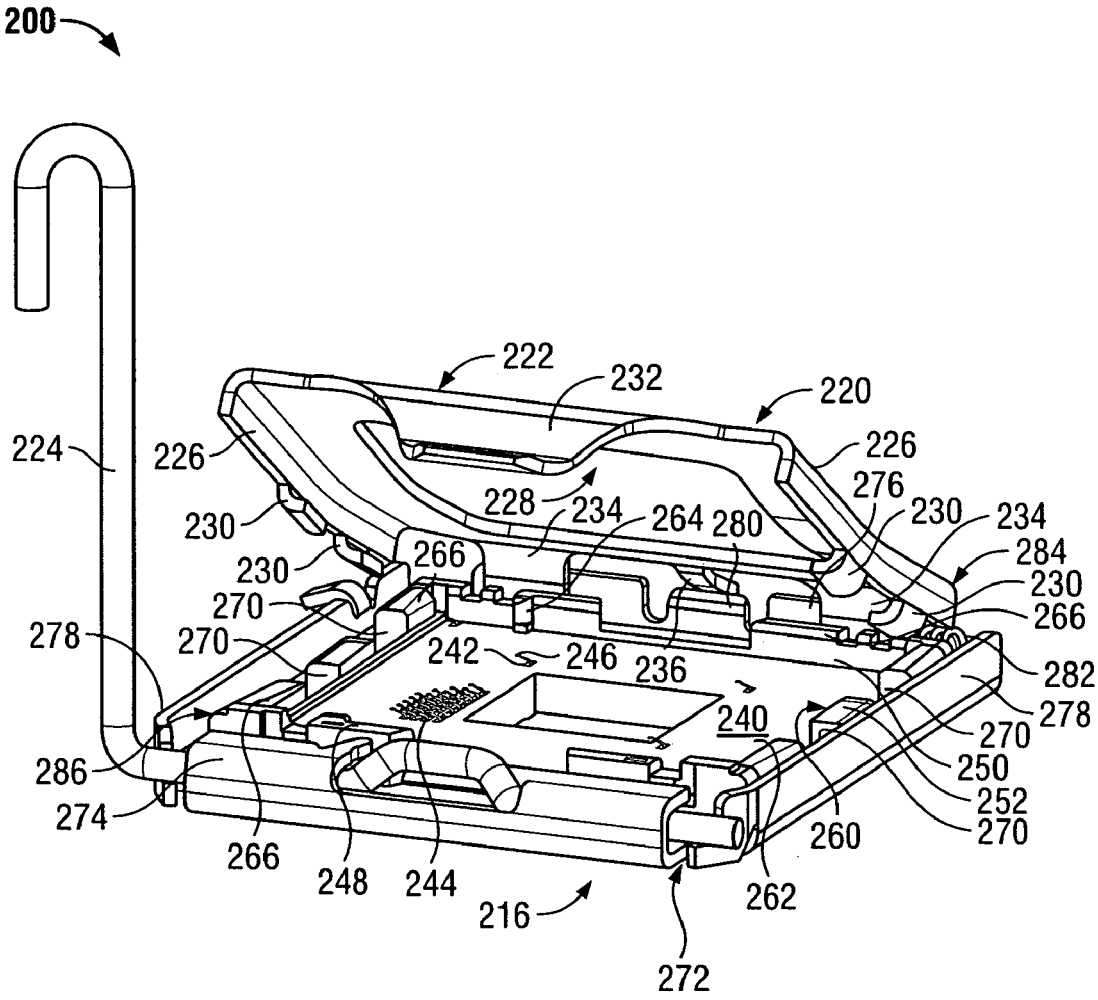
FIG. 5 is a perspective view of an alternative embodiment of a socket connector formed in accordance with the present invention.

FIG. 5 illustrates an alternative embodiment of an LGA connector 200. The connector 200 includes a housing 216, a load plate 220 and a handle 224. The handle 224 is similar to the handle 24 described above.

The load plate 220 is generally rectangular in shape and includes a forward latching end 222, a rearward pivoting end 284, and a pair of opposed sides 226 that extend between the forward latching end 222 and the rearward pivoting end 284. The load plate 220 includes a cutout 228 in a central portion thereof. The sides 226 each include a pair of retention hooks 230 for holding an LGA package (not shown). The forward latching end 222 includes a latch tongue 232 but is otherwise unobstructed and, in contrast to the connector 10, the package is received from the forward latching end 222. The package is slid under the tongue 232 and into the retention hooks 230. The load plate 220 includes hinge tabs 234 that rotatably couple the load plate 220 to the housing 216. A load plate stop tab 236 is formed on the load plate pivoting end 284 to limit the opening of the load plate 220. The sides 226 each have a downward bend at a central portion thereof for applying a downward load on the package as described in the previous embodiment.

The housing 216 is similar to the housing 16 of the previously described embodiment and includes a base 240 which is fabricated from a dielectric material and includes an array of contact cavities 242 that hold an array 244 of individual electrical contacts 246. The housing 216 includes front and back interior walls 248 and 250 respectively, and interior side walls 252. The front and back walls 248 and 250, along with the side walls 252 combine to form a perimeter wall 260 that surrounds the base 240. The front and back walls 248, 250, and side walls 252 extend above the base 240 and thereby define a recess 262 within which the base 240 is located.

The back wall 250 includes a key 264. The front wall includes a similar key (not shown) that, along with the key 264, cooperates to assure that the LGA package (not shown) is properly oriented with respect to the contact array 244 for placement thereon. Each of the front and back walls 248 and 250 and the side walls 252 forming the perimeter wall 260 are provided with a chamfered or beveled surface generally indicated at 266 along an inner upper surface of each of walls 248, 250, and 252. The beveled surfaces 266 operate as alignment ramps or guides that provide the final alignment of the package and guide the package onto the base 240 and the contact array 244. Each side wall 252 includes a pair of relief cutouts 270 that provide clearance for the load plate retention hooks 230.

The housing 216 also includes a stiffener plate 272 that surrounds the perimeter wall 260. The stiffener plate 272 includes a front rail 274, a back rail 276 and opposed side rails 278. Each of the side rails 278 joins the front and back rails 274 and 276 to form a substantially rectangular enclosure 286 wherein the front rail 274 is adjacent the front interior wall 248, the back rail 276 is adjacent the back interior wall 250, and each side rail 278 is adjacent an interior side wall 252. The back rail 276 includes hinge slots (not shown) that receive the load plate hinge tabs 234 and a load plate stop 280 engages the load plate stop tab 236 to limit the opening of the load plate 220. As with the previously described embodiment, a biasing member 282 is provided between the load plate 220 and the stiffener plate 272 to bias the load plate 220 in an open position.

The embodiments thus described provide a socket connector that reduces the potential for damage to the contact array which is exposed during installation of an LGA package. The connector includes a load plate that receives the package and loads the package into the connector housing. The housing includes alignment ramps that align the package prior to placement of the package on the contact array. The load plate is biased in the open position and the opening is limited to reduce the exposure of the contact field to fingers, tools, or other foreign objects.

While the invention has been described in terms of various specific embodiments, those skilled in the art will recognize that the invention can be practiced with modification within the spirit and scope of the claims.

What is claimed is:

1. An electrical connector comprising:

a socket housing holding an array of electrical contacts; and a load plate rotatably coupled to said housing and rotatable between an open position and a closed position, said load plate including a channel configured to receive and retain an electronic package when said load plate is in said open position, said load plate loading the package into said housing as said load plate is rotated to said closed position.

2. The electrical connector of claim 1, further comprising a handle rotatably coupled to said housing to lock said load plate in said closed position.

3. The electrical connector of claim 1, further comprising a biasing member coupled between said load plate and said housing to bias said load plate in said open position.

4. The electrical connector of claim 1, wherein said load plate comprises first and second opposed sides, each said first and second side extending from a forward load plate latching end to a rearward load plate pivoting end, each said side including a downwardly curved portion that applies a downward load to the package when said load plate is in said closed position.

5. The electrical connector of claim 1, wherein said load plate comprises first and second opposite sides, each said first and second sides including a retention hook formed therewith, said retention hooks defining a channel sized to receive the package, a third side including a package stop, and a fourth side opposite said third side, said fourth side receiving the package.

6. The electrical connector of claim 1, wherein said load plate includes a load plate stop tab extending therefrom that engages said housing to limit an opening of said load plate to restrict access to said contact array when said load plate is rotated to said open position.

7. The electrical connector of claim 1, wherein said housing comprises a base including an array of contact cavities for holding said contact array, said base surrounded by front, back and side perimeter walls that define a recess for receiving the package.

8. The electrical connector of claim 1, wherein said housing comprises a base including an array of contact cavities for holding said contact array, said base surrounded by front, back and side perimeter walls that define a recess for receiving the package, and a stiffener plate surrounding said perimeter walls, said load plate rotatably coupled to a stiffener plate back wall.

9. The electrical connector of claim 1, wherein said housing comprises a base including an array of contact cavities for holding said contact array, said base surrounded by front, back and side perimeter walls that define a recess for receiving the package, at least one of said perimeter walls including a key for orienting the package with respect to said recess.

10. The electrical connector of claim 1, wherein said load plate includes a plurality of retention hooks, and said housing comprises a base including an array of contact cavities for holding said contact array, said base surrounded by front, back and side perimeter walls that define a recess for receiving the package, said perimeter walls including clearance cutouts for receiving said retention hooks.

11. An electrical connector comprising:

a socket housing holding an array of electrical contacts, said housing including a guide member to guide an electronic package onto said contact array as the package is loaded into said housing; and a load plate rotatably coupled to said housing and rotatable between an open position and a closed position, said load plate including a channel configured to receive and retain the package when said load plate is in said open position, said load plate loading the package into said housing as said load plate is rotated to said closed position.

12. The electrical connector of claim 11, wherein said housing comprises:

a base including an array of contact cavities for holding said array of electrical contacts; and front, back and side perimeter walls surrounding said base, wherein at least one of said perimeter walls includes an alignment ramp to guide the package onto said contact array.

13. The electrical connector of claim 11, wherein said housing comprises:

a base including an array of contact cavities for holding said array of electrical contacts; and front, back and side perimeter walls surrounding said base, wherein at least one of said perimeter walls includes an alignment ramp to guide the package onto said contact array, said alignment ramp comprising a bevel on an upper edge of said at least one perimeter wall.

14. The electrical connector of claim 11, further comprising a handle rotatably coupled to said housing to lock said load plate in said closed position.

15. The electrical connector of claim 11, further comprising a biasing member coupled between said load plate and said housing to bias said load plate in said open position.

16. The electrical connector of claim 11, wherein said load plate comprises first and second opposed sides, each said first and second side extending from a forward load plate latching end to a rearward load plate pivoting end, each said side including a downwardly curved portion that applies a downward load to the package when said load plate is in said closed position.

17. The electrical connector of claim 11, wherein said load plate comprises first and second opposite sides, each said first and second sides including a retention hook formed therewith, said retention hooks defining a channel sized to receive the package, a third side including a package stop, and a fourth side opposite said third side, said fourth side receiving the package.

18. The electrical connector of claim 11, wherein said load plate includes a load plate stop tab extending therefrom that engages said housing to limit an opening of said load plate to restrict access to said contact array when said load plate is rotated to said open position.

19. The electrical connector of claim 11, wherein said housing comprises a base including an array of contact cavities for holding said contact array, said base surrounded by front, back and side perimeter walls that define a recess for receiving the LGA package, at least one of said perimeter walls including a key for orienting the package with respect to said recess.

20. The electrical connector of claim 11, wherein said housing comprises a base including an array of contact cavities for holding said contact array, said base surrounded by front, back and side perimeter walls that define a recess for receiving the package, and a stiffener plate surrounding said perimeter walls, said load plate rotatably coupled to a stiffener plate back wall.

21. An electrical connector comprising:

a socket housing holding an array of electrical contacts, said housing including a guide member to guide an electronic package onto said contact array as the package is loaded into said housing; and a load plate rotatably coupled to said housing and rotatable between an open position and a closed position, said load plate including a channel configured to receive and retain the package when said load plate is in said open position, and a lip that orients the package with respect to said housing, said load plate loading the package into said housing as said load plate is rotated to said closed position.

22. The electrical connector of claim 21, wherein said load plate comprises first and second opposed sides, each said first and second side extending from a forward load plate latching end to a rearward load plate pivoting end, each said side including a downwardly curved portion that applies a downward load to the package when said load plate is in said closed position.

23. The electrical connector of claim 21, wherein said load plate comprises first and second opposite sides, each said first and second sides including a retention hook formed therewith, said retention hooks defining a channel sized to receive the package, a third side including a package stop, and a fourth side opposite said third side, said fourth side receiving the package.

* * * * *